United States Patent [19]

Pedersen

[11] 4,290,401

[45] Sep. 22, 1981

[54] VAPORIZATION MEANS FOR LIQUID FUEL

[76] Inventor: John R. C. Pedersen, 27, Greenway, Woodmancote, Cheltenham, England

[21] Appl. No.: 889,293

[22] Filed: Mar. 23, 1978

[51] Int. Cl.[3] ..... F02M 17/18

[52] U.S. Cl. ..... 123/524; 123/523; 123/437

[58] Field of Search ..... 236/91 G; 261/36 A, 261/106, 105, 39 A; 123/133, 119 EL, 523, 524, 437

[56] References Cited

U.S. PATENT DOCUMENTS

| | | | |
|---|---|---|---|
| 46,432 | 2/1865 | Buckland | 123/133 |
| 420,591 | 2/1890 | Dawson | 123/133 |
| 528,882 | 11/1894 | Keller | 123/133 |
| 1,069,068 | 7/1913 | Kemp | 261/105 |
| 1,165,087 | 12/1915 | Fulton | 261/39 A |
| 1,640,291 | 8/1927 | Perkins | 261/106 |
| 1,860,111 | 5/1932 | Miller | 261/106 |
| 2,042,289 | 5/1936 | Baldwin | 261/106 |
| 2,262,013 | 11/1941 | Lang | 261/105 |
| 2,310,739 | 2/1943 | Lang | 261/36 A |
| 2,782,996 | 2/1957 | Sparrow | 236/91 G |
| 3,336,734 | 8/1967 | Schultz | 261/36 A |
| 3,411,489 | 11/1968 | Kruger | 123/133 |
| 3,722,837 | 3/1973 | Dapprich | 261/105 |
| 3,841,283 | 10/1974 | Wood | 123/119 R |
| 3,864,105 | 2/1975 | Davis | 261/36 A |
| 3,888,954 | 6/1975 | Eberle | 261/36 A |

*Primary Examiner*—Ronald H. Lazarus
*Attorney, Agent, or Firm*—Young & Thompson

[57] ABSTRACT

In vaporization means for liquid fuel for an internal combustion engine, the mixture strength is measured and used to control the rate of flow of liquid fuel into the air stream so as to maintain the mixture strength constant. Measurement of mixture strength is effected by measuring the temperature drop in the air flow due to the latent heat of the liquid fuel.

7 Claims, 10 Drawing Figures

50
78
76
83
LIQUID
FUEL
80
82
54
58
74
72
MIXTURE 84
50
96
54
102
LIQUID
FUEL
96
86
98
101
100
58
92
98
94
92
AIR
88
90
MIXTURE 92
94
92

VAPORIZATION MEANS FOR LIQUID FUEL

This invention relates to vaporization means for liquid fuel and has particular application to the provision of means for evaporating liquid fuel into a stream of air having a closed-loop control for maintaining the mixture strength at the required value.

According to the invention, vaporization means for liquid fuel comprises means for evaporating liquid fuel into a stream of air, means for measuring the strength of the mixture of evaporated fuel and air, and control means responsive to the measuring means and adapted to adjust the rate of evaporation of liquid fuel to maintain the mixture strength at a predetermined value.

Evaporation of the liquid fuel is employed because a conventional atomizer carburetter produces a two-phase product. Measurement of the mixture strength of such a two-phase product is effectively impracticable. For this reason, existing closed-looped systems for controlling mixture strength measure the exhaust gases from the engine in which the mixture is used.

The evaporating means can take the form of a boiler using an external heat source but preferably comprises means for exposing a surface of the liquid to the air flow, the heat content of the air being used to provide the required latent heat. The use of this latter arrangement in a thermally insulated system has the advantage that mixture strength can be determined from the temperature drop in the air as it passes through the evaporator since this temperature drop increases as mixture strength increases and is independent of air flow rate. For a stoichiometric mixture, the temperature drop is about 25° C. In practice, a leaner mixture is required to optimise economy and minimise exhaust pollution, for which purpose 20° C. is a suitable temperature drop. The use of temperature difference across the evaporator as a measure of mixture strength does not preclude preheating the incoming air stream provided that this is done before the incoming air temperature is measured.

Figure 1:
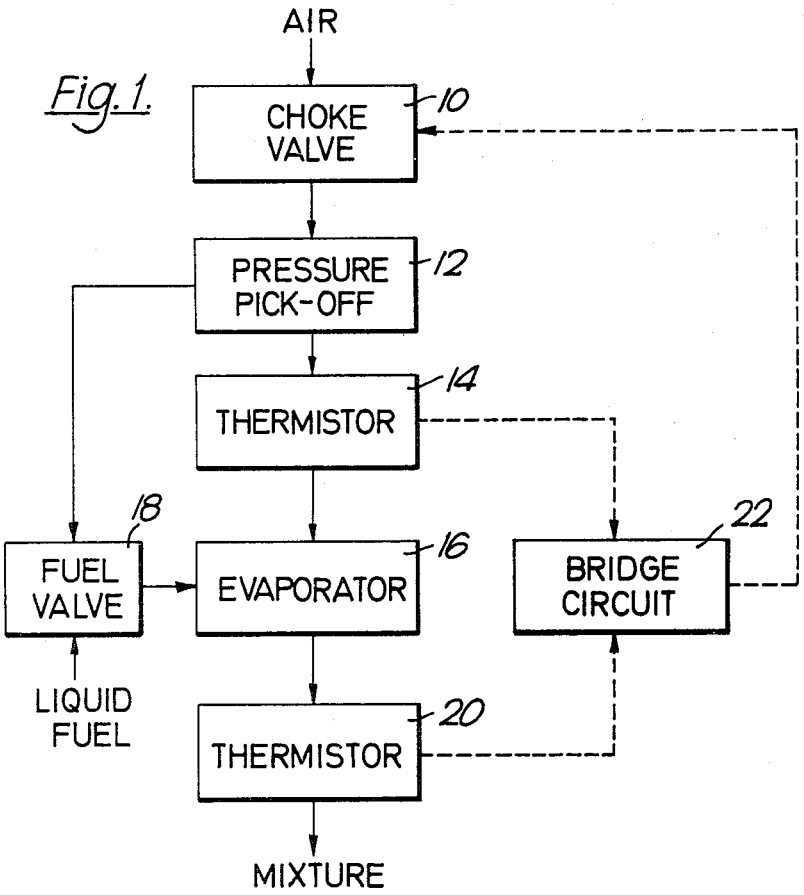
Figure 2:
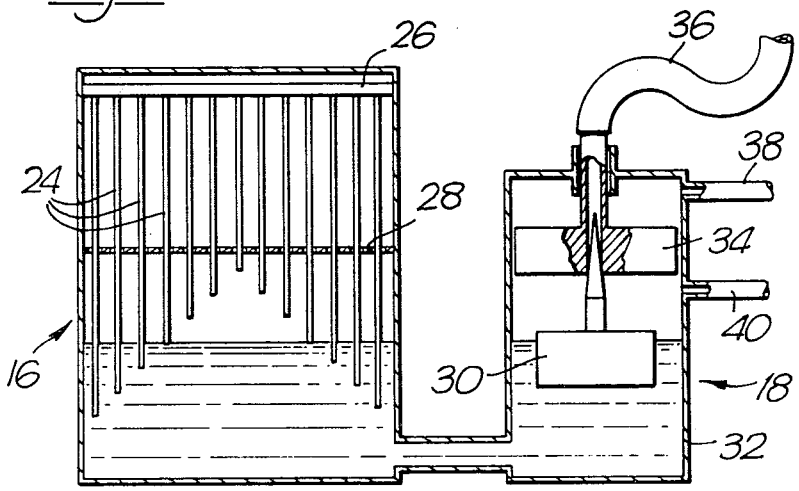
Figure 3:
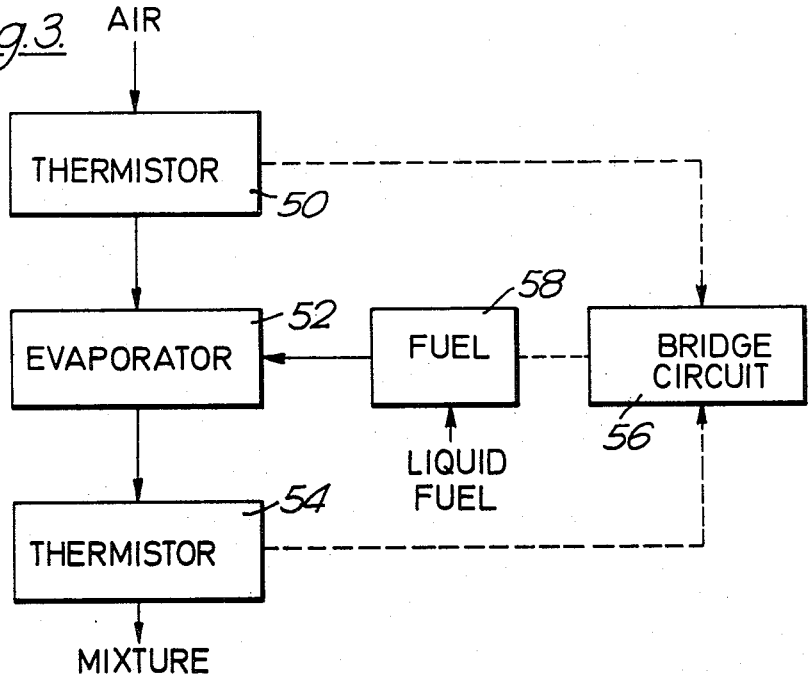
Figure 4:
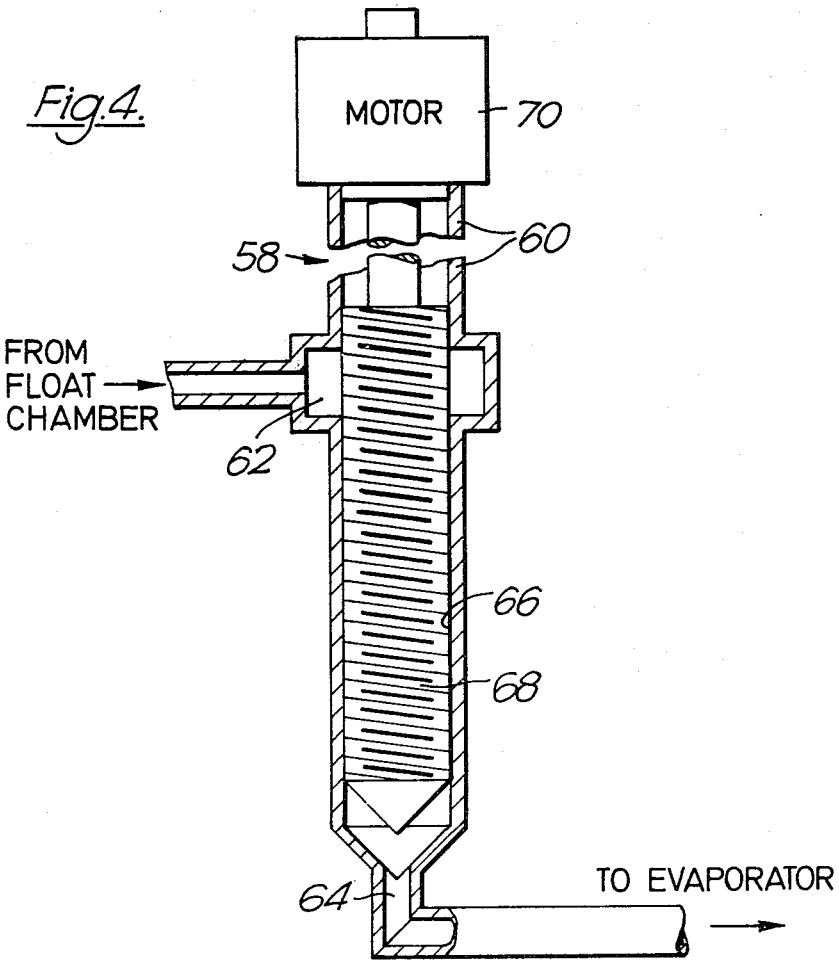
Figure 5:
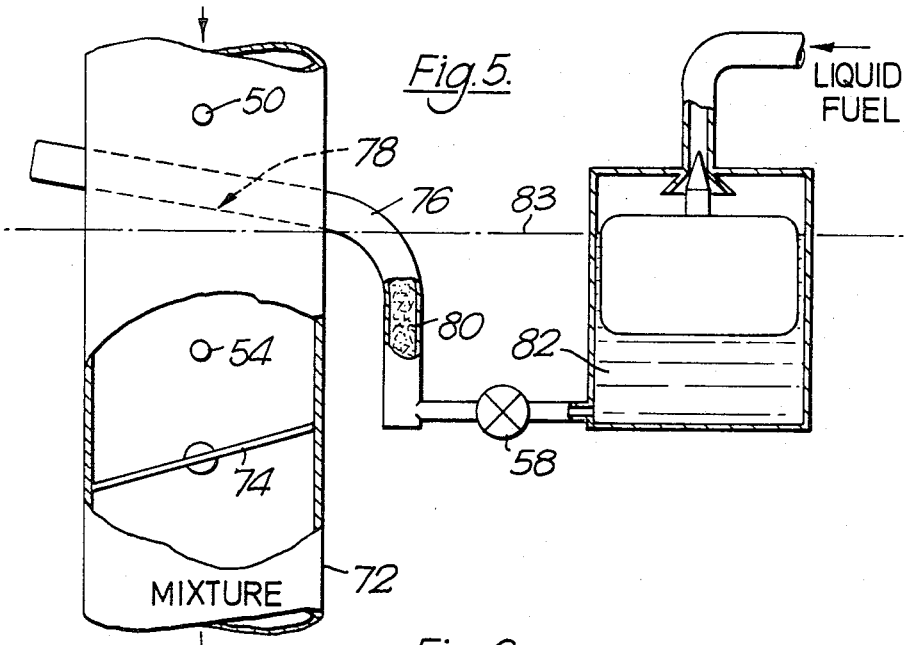
Figure 6:
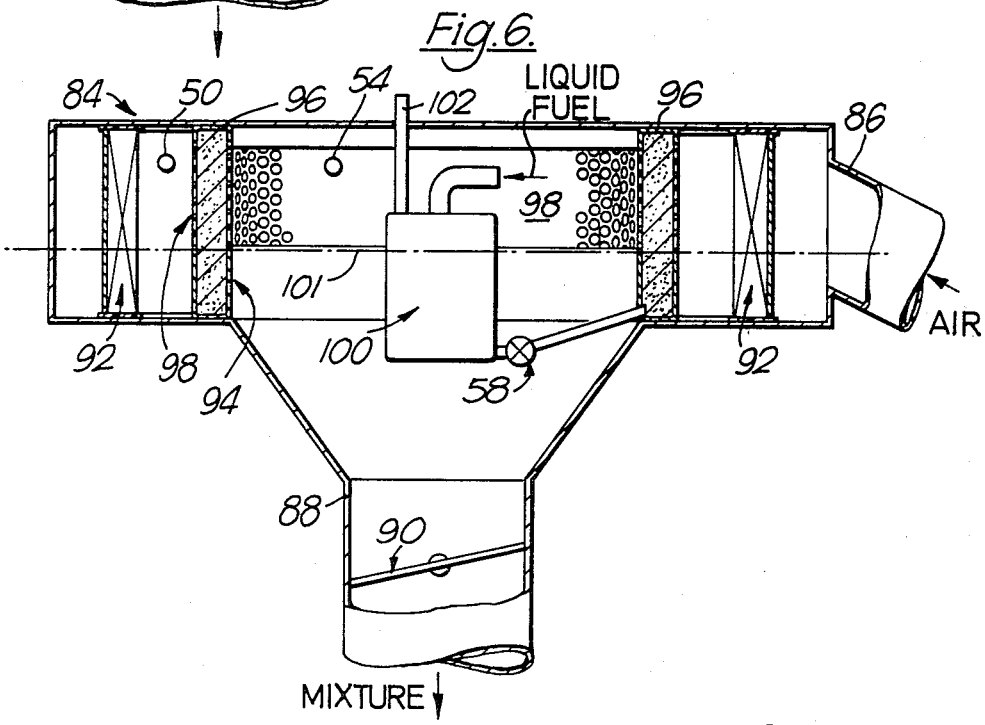
Figure 7:
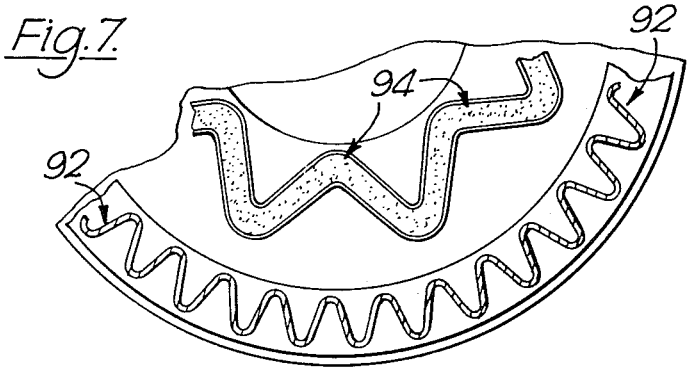
Figure 8:
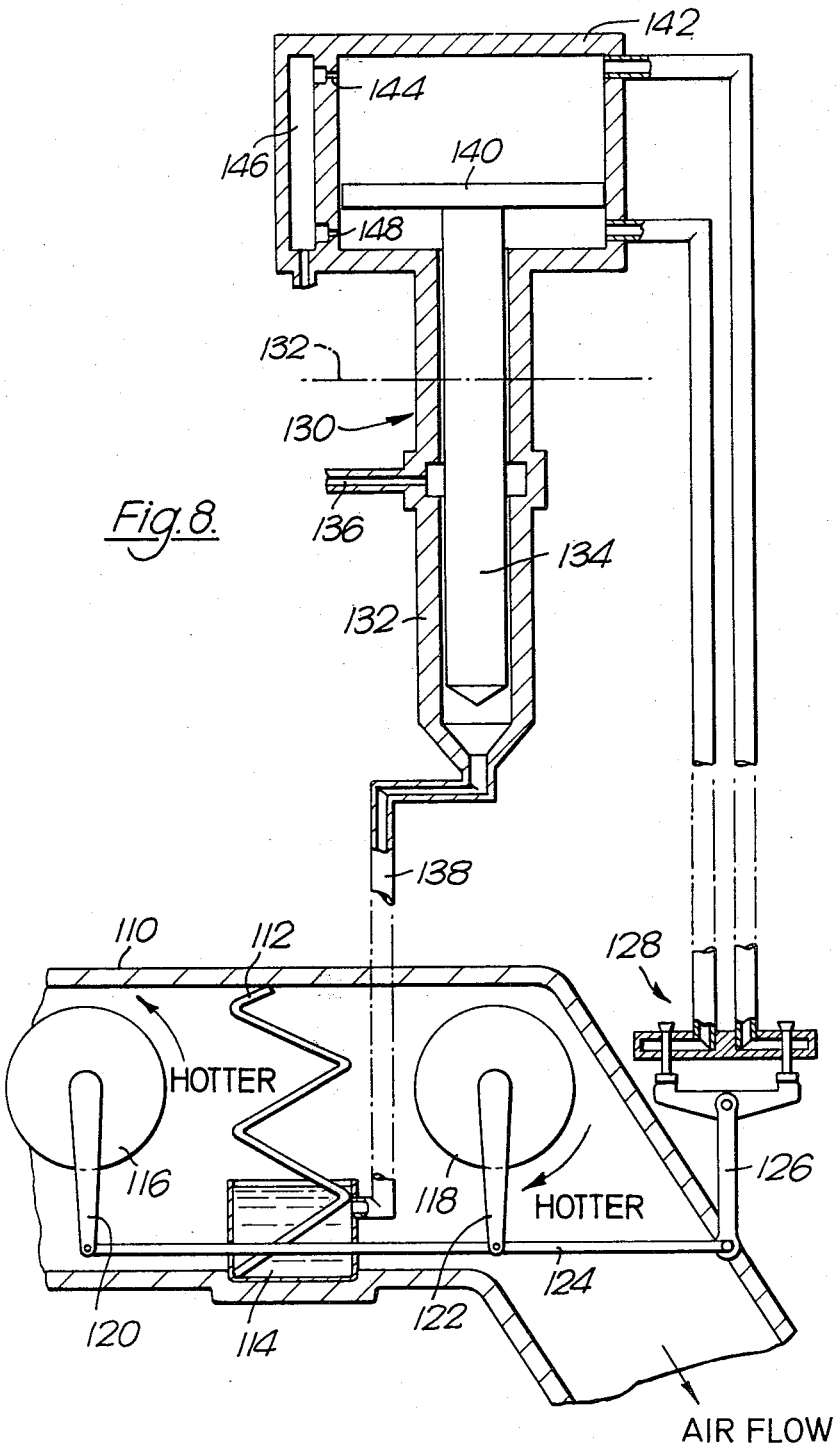
Figure 9:
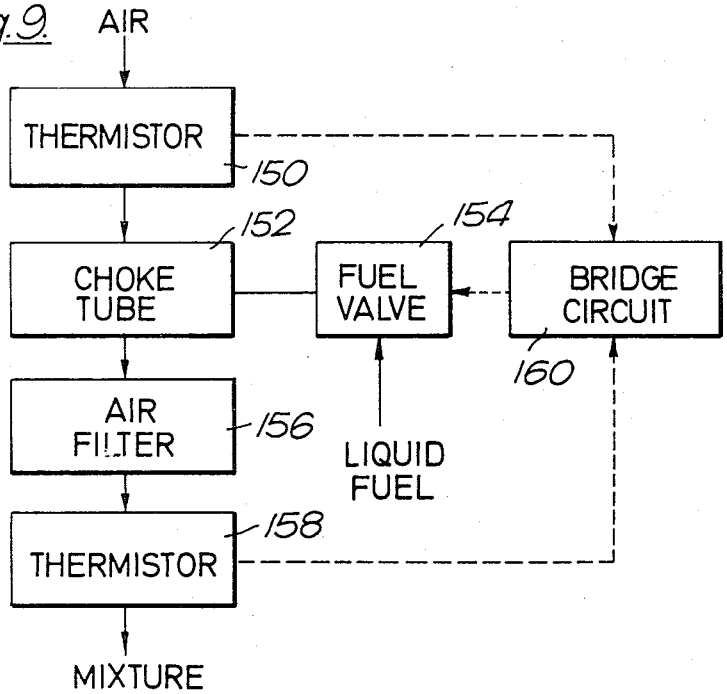
Figure 10:
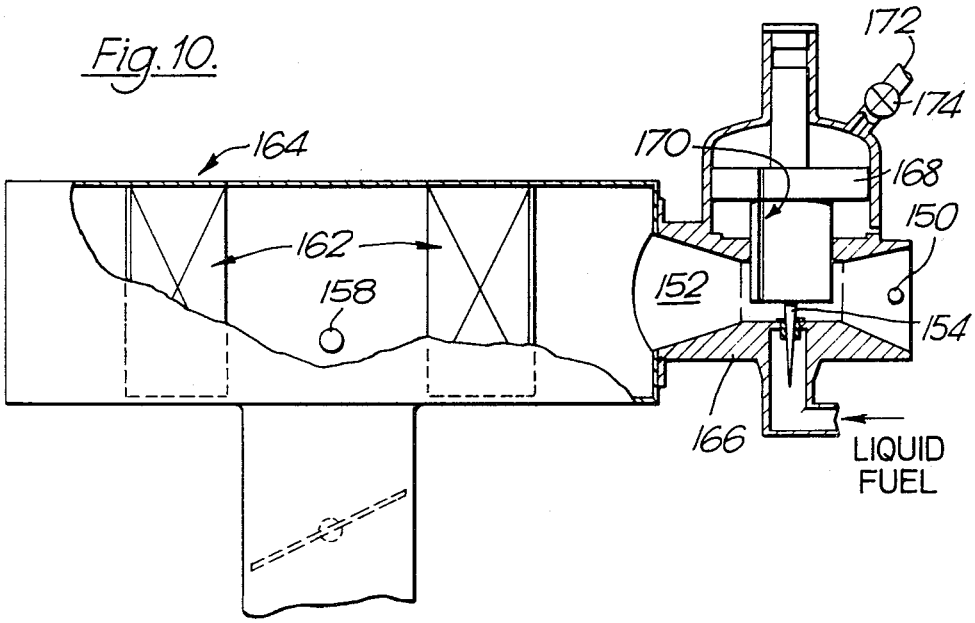

Embodiments of the invention will now be described, by way of example, with reference to the accompanying drawings, in which;

FIG. 1 is a block diagram of a first embodiment of the invention,

FIG. 2 is a schematic cross-sectional view of an evaporator for use in the embodiment shown in FIG. 1, FIG. 3 is a block diagram of another embodiment of the invention, FIG. 4 is a schematic cross-sectional view of a fuel valve for use with the embodiment shown in FIG. 3, FIGS. 5 and 6 are schematic cross-sectional views of alternative forms of evaporator for use with the embodiment shown in FIG. 3, FIG. 7 is a fragmentary plan view of part of the evaporator shown in FIG. 6, FIG. 8 is a schematic cross-sectional view of another embodiment of the invention, FIG. 9 is a block diagram of a further embodiment of the invention, and FIG. 10 is a schematic cross-sectional view of an evaporator for use with the embodiment shown in FIG. 9.

Referring to FIG. 1, the air required to form a fuel-/air mixture is drawn in through a choke valve 10 and flows past a pressure pick-off 12 and a thermistor 14 to an evaporator 16. Liquid fuel is supplied to the evaporator 16 via a fuel valve 18 and the fuel/air mixture from the evaporator 16 flows past a second thermistor 20 before being supplied to the inlet manifold (not shown) of an engine in which it is to be used. The two thermistors 14 and 20 are connected in a bridge circuit 22, the output of which provides an indication of any temperature difference across the evaporator.

Referring to FIG. 2, the evaporator 16 comprises a plurality of flat wicks 24 suspended vertically from a support 26 and projecting between a spacer grid 28. The wicks are of different lengths so that the number of wicks which are wet at any one time can be controlled by varying the level of liquid fuel in the evaporator. The flow of air through the evaporator is in a substantially horizontal direction parallel to the flat surfaces of the wick, i.e. perpendicular to the plane of the drawing. A consequence of this is that all air is subject to the same flow resistance and the ratio of "wetted" air to dry air is substantially independent of air flow rate. The mixture strength is therefore also independent of air flow rate provided that the wicks are large enough to effectively saturate the air in contact with those wicks which are wetted and the range of air flow rates does not include the transition between laminar and turbulent flow.

The level of liquid fuel in the evaporator 16 is controlled by the fuel valve 18 which takes the form of a needle valve operated by a float 30 in an adjacent float chamber 32. The top of the float chamber 32 is enclosed by a piston 34 which is reciprocable in the vertical direction and which contains the valve seat, the liquid fuel being supplied to the piston 34 via a flexible connection 36. Thus the mixture strength can be increased by raising the piston in the float chamber and decreased by lowering it.

It will be realized that the response of the mixture strength to changes in the float level will be relatively slow because of the time taken for a wick removed from the liquid fuel to dry and the time for liquid fuel to soak up to the top of a wick after the bottom thereof has first been dipped into the liquid. In order to provide for rapid changes in mixture strength, the output of the bridge circuit 22 (FIG. 1) is arranged to operate the choke valve 10; the pressure pick-off 12, which responds to the position of the choke valve, is arranged to operate the fuel valve 18. The output of the pressure pick-off 12 is connected via a duct 38 (FIG. 2) to the air space above the piston 34 and the air space in the float chamber 32 between the piston 34 and the liquid surface is connected, via a duct 40, to atomsphere, i.e. to the pressure upstream of the choke valve 10. Consequently, the pressure difference developed across the choke valve 10 is applied across the piston 34 which is therefore raised to raise the liquid level in the evaporator 16 if the choke valve 10 closes.

Instead of varying the liquid level in the evaporator 16, the wicks themselves may be raised and lowered while the liquid level is maintained constant.

The foregoing embodiment is subject to the disadvantage that there is a discontinuity in the rate of transfer of vapour from the wick to the mixture at the flow rate at which the change between laminar and turbulent flow takes place. This rate of transfer is given by $$\frac{\rho_s - \rho_m}{\rho_s} = e^{\frac{-41}{d} NSt}$$

where:

$\rho s$ is the vapour density at the surface of the wick
$\rho m$ is the vapour density of the mixture
l is the length of the air flow path through the wick
d is the hydraulic mean diameter
$N_{St}$ is the Stanton number The vapour density $\rho s$ at the surface of the wick is a function of temperature and is proportional to the fraction of the total area of the wick which is wetted by the liquid fuel. The Stanton number $N_{St}$ varies with Reynolds number, being substantially constant in turbulent flow, varying with flow rate in laminar flow and suffering the above mentioned discontinuity at the transition between laminar and turbulent flow. The disadvantage of this discontinuity can be avoided if a wick is disposed across the path of air flow so that flow is laminar at all practical rates of flow. Since air flows through the whole of the wick at all times, it is necessary to provide an alternative means for varying the rate of evaporation. This can be done by controlling the rate of flow of liquid fuel to the wick but it is necessary to reduce dead volume of fuel to a minimum and to provide a fuel flow control valve which enables fuel flow rate to be maintained proportional to air flow rate. The air pressure drop across the wick is proportional to flow rate and consequently the fuel valve should also have a linear relationship between pressure drop and flow. The valves used in the following embodiments have this property because pressure drop therein depends on friction rather than acceleration through an orifice.

Referring to FIG. 3, air to form the required fuel/air mixture is drawn past a thermistor 50 and into an evaporator 52. The fuel/air mixture formed therein is drawn past a second thermistor 54 to the inlet manifold (not shown) of an engine in which the fuel is to be used. The thermistors 50 and 54 are connected in a bridge circuit 56, the output of which controls a fuel valve 58 for metering liquid fuel supplied to the evaporator 52.

Referring to FIG. 4, the valve 58 comprises a vertically mounted tube 60 having a portion of enlarged diameter 62 forming a fuel inlet chamber at an intermediate position along the length thereof and an outlet 64 at the bottom thereof for communication with the evaporator 52 (FIG. 3). The portion of the tube 60 between the inlet chamber 62 and the outlet 64 has a female thread formed on the inner wall thereof and a corresponding male threaded member 66 is screwed therein. Thus the flow path for liquid fuel from the inlet 62 to the outlet 64 is through the thread clearance between the threaded member 68 and the thread 66 formed on the inside of the tube 60. The length, and therefore the flow resistance of this path can be varied by screwing the threaded member 68 upwardly and downwardly. For this purpose, the threaded member 68 is coupled to the output shaft of D.C. electric motor 70 which is connected to the output of the bridge circuit 56, the latter being arranged to be in balance when the voltage difference between the thermistors 50 and 54 corresponds to the required temperature difference across the evaporator. The supply of liquid fuel is from a conventional float chamber arranged to maintain the fuel level above that of the inlet 62, the precise level not being critical.

FIG. 5 shows a form of evaporator suitable for use as the evaporator 52 when the system shown in FIG. 3 is to be applied to a relatively small engine. The evaporator comprises a tube 72 containing the thermistors 50 and 54 together with a throttle 74 located downstream of the second thermistors 54. A generally L-shaped wick tube 76 has one limb 78 extending generally horizontally across the tube 72 and the other limb 80 extending vertically downwards outside the tube 72. The portion of the limb 78 within the tube 72 is perforated so as to expose the wick therein to air flowing through the evaporator. Liquid fuel is supplied from a conventional float chamber 82 via the valve 58 to the bottom of the limb 80, the float valve in the chamber 82 being set to maintain the level of liquid fuel indicated by the line 83 just below the portion of the wick tube 76 which is within the evaporator tube 72. Thus, while the area of wick exposed to the air flow is the same at all times, the rate of evaporation of fuel is controlled by the valve 58.

FIG. 6 shows another form of evaporator which is particularly suitable for use with larger engines. The evaporator housing 84 is generally cylindrical and is similar to a conventional internal combustion engine air filter in that the air inlet 86 is located in the outer cylindrical wall thereof and the mixture outlet is through a tube 88 which is coaxial with the cylindrical housing 84. The tube 88 contains a throttle 90. An air filter 92 is located within the housing 84 radially inwardly of the inlet 86. The filter 92 surrounds a generally cylindrical wick assembly comprising a wick trough 94 on which a wick cap 96 is supported by a perforated cap support 98 so as to expose a wick therein to the radially inward air flow. Fuel is supplied to the wick trough 94 from a conventional float chamber 100 via the fuel valve 58. The float chamber 100, which is arranged to maintain the level of liquid fuel, indicated by the line 101, below the top of the wick trough 94, can conveniently be located within the housing 84 and provided with a vent 102 to atmosphere in order to permit correct operations of the float valve therein.

The evaporator shown in FIG. 6 exposes a much greater area of wick to the air flow than does the evaporator shown in FIG. 5. Consequently, the former can produce the required fuel/air mixture at a much greater flow rate. The flow rate which can be accommodated can be further increased by forming both the wick trough 94 and the air filter 92 in a pleated manner, as shown in FIG. 7, so as to increase the effective areas thereof.

FIG. 8 illustrates an entirely mechanical version of the system illustrated in FIGS. 3, 4 and 5. The evaporator shown in FIG. 8 comprises a duct 110 containing a wick 112 with its bottom in a wick trough 114. Instead of thermistors, bimetallic helices 116 and 118 are provided upstream and downstream of the wick 112 respectively. Each helix has one end fixed and the other end connected to operate a respective radial lever 120, 122. The upstream helix 116 is so arranged that, as temperature increases, its lever 120 tends to move in an anti-clockwise direction, as viewed in FIG. 8 while the lever 122 of the downstream helix 118 tends to move in a clockwise direction. The outer end of the two levers 120 and 122 are coupled together by a rod 124, movement of which thus depends on the difference in the temperatures sensed by the two helices 120 and 122. One end of the rod 124 is connected to the operating lever 126 of a differential blead valve 128.

Liquid fuel is supplied to the wick trough 114 via a metering valve 130. For convenience of representation, the valve 130 is shown in FIG. 8 as above the duct 110 but it should be understood that, in practice, the two are disposed at substantially the same level so that the level of liquid fuel in the metering valve 130, indicated by the line 132, is the same as the liquid level 134 in the wick trough 114.

The metering valve 130 comprises a vertical tube 132 having a plunger 134 mounted therein. The diameter of the plunger 134 is only slightly less than the internal diameter of the tube 132 so that the small annular gap therebetween provides a high resistance liquid flow path between a liquid flow inlet 136 and the bottom of the tube 132. The bottom of the tube 132 is coupled by a pipe 138 to the wick trough 114. The plunger 134 is reciprocally moveable in the tube 132 so that the arrangement provides a variable resistance flow path for the liquid fuel from the inlet 136 to the trough 114 in an analogous manner to the valve 58 (FIG. 4). The supply of liquid fuel to the inlet 136 is from a conventional float chamber (not shown).

In order to cause the required reciprocal movement of the plunger 134, a piston 140 is mounted on the upper end thereof. The piston 140 moves in a cylinder 142. The part of the cylinder 142 above the piston is connected both to one port of the differential bleed valve 128 and, via a restrictor 144 to a plenum 146. Similarly, the region of the cylinder 142 below the piston 140 is connected both to the other port of the differential bleed valve 128 and, via a restrictor 148 to the plenum 146. The plenum 146 is, in turn, connected to the inlet manifold of the engine being supplied by the evaporator, which forms the lowest conveniently available pressure. Thus, if the differential bleed valve 128 is in its central position with both ports closed, there is no pressure difference across the piston 140 and the plunger 134 remains stationary. If the temperature on the downstream side of the evaporator increases relative to that on the upstream side, indicating a reduced rate of evaporation, the rod 124 moves to the left and the left hand port of the differential bleed valve opens, venting the part of the cylinder 142 below the piston 140 to atmosphere so that the pressure therein increases, raising the plunger 134 and thus increasing the rate of flow to the wick trough 114. Conversely, if the temperature sensed by the helix 118 decreases, indicating an increased rate of evaporation, the rate of flow of liquid fuel to the wick trough 114 is reduced.

Instead of an evaporator having a dip-feed wick, an evaporator may be provided in which liquid fuel is sprayed on to the wick in droplet form, the wick comprising a filter covering the whole of the airway. The liquid fuel is converted into a droplet form and mixed with the incoming air stream using a conventional carburettor. The droplets are caught on the filter where they evaporate. An evaporator system of this type is shown in FIG. 9. The incoming air flows past a first thermistor 150 and into the choke tube 152 of a carburettor. Liquid fuel is admitted into the choke tube from the fuel valve 154 of the carburettor and the resulting mixture of air and droplets of fuel is sprayed on to an air filter 156 where the liquid fuel evaporates. The temperature of the resulting mixture is sensed by a second thermistor 158. The two thermistors 150 and 158 are connected in a bridge circuit 160, the output of which is used to control the rate of supply of liquid fuel by the fuel valve 154.

FIG. 10 shows an implementation of the evaporation system of FIG. 9. An annular pleated air filter 162 is disposed within a cylindrical housing 164. The outlet of a carburettor 166 is coupled to a port in the cylindrical wall of the housing 164. The fuel valve 154 takes the form of a needle mounted on a piston 168 having a restricted vacuum connection 170 leading therethrough. The space above the piston 168 is also connected to atmosphere via a vent 172 which is controlled by a valve 174 which, in turn, is operated by the output of the bridge circuit 160 (FIG. 9) so as to increase the rate of supply of fuel if the temperature difference indicated by the thermistors 150 and 158 decreases and vice versa.

When the evaporator takes the form of a boiler, involving the use of an external heat source, the temperature difference across the evaporator cannot be used as a measure of mixture strength. One technique which can be used in these circumstances involves the dependance of the speed of sound in the mixture on the mean molecular weight thereof. A sample of mixture is drawn from the outlet of the evaporator and supplied to a Helmholtz resonator containing a transducer which is connected in the feedback path of an amplifier. A second resonator is supplied with a sample of air. Both samples are dumped to the engine inlet manifold. The two resonators may be tuned to resonate at the same frequency when the mixture has the required strength. The output of the amplifiers of the two resonators are connected to a phase sensitive detector, the output of which is used to control the mixture strength. Alternatively, the two oscillators may be of the same size in which case the resulting difference of the resonant frequencies is compared with a reference frequency.

Another method involves the use of wet and dry bulb thermometers, the wet bulb thermometer being exposed to the mixture. The difference in readings of the two thermometers then depends on the amount of vapour in the mixture. However, this method suffers from the disadvantage that the required difference is dependent on the absolute magnitude of the temperature indicated by the dry bulb thermometer.

A third alternative is to measure the temperature rise on burning an abstracted sample of the mixture.

I claim:

1. Vaporization means for liquid fuel, comprising a reservoir for liquid fuel, an air passage for a stream of air, a wick for delivery of fuel in a substantially completely vaporized form and/or with a substantially constant liquid/vapor ratio to a location intermediate the ends of the passage, means for limiting supply of fuel from the reservoir to the wick so that the strength of the resultant mixture of vaporized fuel and air is independent of the air flow, temperature sensitive means, including a thermistor disposed in the air passage upstream of the evaporator, a thermistor disposed in the air passage downstream of the evaporator, said thermistors being connected in a bridge circuit for monitoring the temperature difference between the incoming air stream and the mixture of vaporized fuel and air, and control means for adjusting the quantity of fuel supplied from the reservoir to the wick in dependence on the output from the bridge circuit to maintain the mixture strength at a predetermined value.

2. Vaporization means according to claim 1, wherein the control means is adapted to maintain the mixture strength at any chosen one of a predetermined range of values.

3. Vaporization means according to claim 1, there being a plurality of said wicks disposed parallel to the direction of air flow.

4. Vaporization means according to claim 3, wherein each wick is of a different length, the wicks being suspended over a trough to which liquid fuel is supplied, the control means being arranged to vary the relative position of the bottoms of the wicks and the surface of the liquid fuel in the trough, thereby to vary the number of wicks dipping into the liquid fuel.

5. Vaporization means according to claim 1, wherein said wick is disposed transversely to the direction of the air flow.

6. Vaporization means according to claim 5, wherein the bottom of the wick extends into a trough for receiving liquid fuel and the control means is arranged to adjust the rate of supply of liquid fuel to the trough.

7. Vaporization means according to claim 6, wherein the control means includes a valve for controlling the rate of supply of liquid fuel comprising a liquid flow path of restricted cross-section and means for varying the length of said flow path.

* * * * *